US011662188B2

(12) United States Patent
Salisbury et al.

(10) Patent No.: US 11,662,188 B2
(45) **Date of Patent: *May 30, 2023**

(54) SYSTEMS AND METHODS FOR A DART FOR A CONDUCTED ELECTRICAL WEAPON

(71) Applicant: Axon Enterprise, Inc., Scottsdale, AZ (US)

(72) Inventors: Luke A. Salisbury, Scottsdale, AZ (US); Michael E. Gish, Scottsdale, AZ (US); Kevin Brian Terence Coles, Creaton (GB)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/537,161

(22) Filed: Nov. 29, 2021

(65) Prior Publication Data

US 2022/0260350 A1 Aug. 18, 2022

Related U.S. Application Data

(63) Continuation of application No. 16/886,374, filed on May 28, 2020, now Pat. No. 11,187,504, which is a (Continued)

(51) Int. Cl.

| | |
|---|---|
| ***H01T 23/00*** | (2006.01) |
| ***F42B 8/12*** | (2006.01) |
| ***F41H 13/00*** | (2006.01) |

(52) U.S. Cl.

CPC ..... *F42B 8/12* (2013.01); *F41H 13/0025* (2013.01)

(58) Field of Classification Search

None

See application file for complete search history.

(56) References Cited

U.S. PATENT DOCUMENTS

| | | |
|---|---|---|
| 4,735,612 A | 4/1988 | Chevalier |
| 4,863,428 A | 9/1989 | Chevalier |

(Continued)

FOREIGN PATENT DOCUMENTS

WO 2009005541 A1 1/2009

OTHER PUBLICATIONS

European Patent Office, Extended Search Report for European Patent Application EP 17905975, p. 1-7.

(Continued)

*Primary Examiner* — Stephen W Jackson

(74) *Attorney, Agent, or Firm* — Carmel Zhao; Andrew Graham

(57) ABSTRACT

A system for a practice electrode (e.g. dart) for a conducted electrical weapon ("CEW"). An officer issued a CEW is required to practice with the CEW in order to maximize its safe and effective use in a stressful situation. Preferably, training is performed using equipment as similar as possible to the equipment an officer uses in the field. Training with a CEW against a live target may be improved, at least from the perspective of the target, by using a practice dart that is similar in weight and flight to a conventional electrode, but that does not pierce target clothing or tissue or deliver a high voltage current through the target. A practice dart may be similar to a conventional electrode but include additional structure (e.g. cap) that prevents piercing. The additional structure and/or a non-conductive filament may reduce a likelihood of or preclude delivery a current through the target.

20 Claims, 8 Drawing Sheets

Related U.S. Application Data continuation of application No. 15/678,794, filed on Aug. 16, 2017, now Pat. No. 10,712,136.

(60) Provisional application No. 62/487,437, filed on Apr. 19, 2017.

(56) References Cited

U.S. PATENT DOCUMENTS

| | | | | |
|---|---|---|---|---|
| 5,333,881 | A | 8/1994 | Cugliari | |
| 6,062,997 | A | 5/2000 | Seymour | |
| 7,237,352 | B2 | 7/2007 | Keely | |
| 7,520,081 | B2 | 4/2009 | Kroll | |
| 8,074,573 | B1 | 12/2011 | Linker | |
| 8,342,098 | B2 | 1/2013 | Cugliari | |
| 9,125,389 | B1 | 9/2015 | Calvert | |
| 10,066,906 | B2 * | 9/2018 | Heroor | H04L 63/061 |
| 10,627,195 | B2 * | 4/2020 | Nerheim | F41H 13/0025 |
| 10,712,136 | B2 | 7/2020 | Salisbury et al. | |
| 11,187,504 | B2 * | 11/2021 | Salisbury | F42B 8/12 |
| 2006/0187610 | A1 | 8/2006 | Su | |
| 2011/0176250 | A1 | 7/2011 | Hinz et al. | |
| 2015/0018143 | A1 | 1/2015 | Chia | |
| 2016/0015499 | A1 | 1/2016 | Scott et al. | |

OTHER PUBLICATIONS

International Searching Authority, International Search Report for the International Patent Application No. PCT/US2017/047177 dated Jan. 8, 2018.

European Patent Office, Communication Pursuant to Article 94(3) EPC for European Application No. 17905975.3-1005 dated Feb. 7, 2022.

* cited by examiner

SYSTEMS AND METHODS FOR A DART FOR A CONDUCTED ELECTRICAL WEAPON

CROSS-REFERENCE TO RELATED APPLICATIONS

This application is a continuation of U.S. application Ser. No. 16/886,374, filed May 28, 2020, which is a continuation of U.S. application Ser. No. 15/678,794, filed Aug. 16, 2017, now U.S. Pat. No. 10,712,136, which claims priority to, and the benefit of, U.S. Provisional Patent Application No. 62/487,437, filed on Apr. 19, 2017, and entitled "Systems and Methods for a Dart for a Conducted Electrical Weapon," each of which are herein incorporated by reference in their entirety.

FIELD OF INVENTION

Embodiments of the present invention relate to a conducted electrical weapon ("CEW").

BRIEF DESCRIPTION OF THE SEVERAL VIEWS OF THE DRAWING

Embodiments of the present invention will be described with reference to the drawing, wherein like designations denote like elements, and.

Figure 1:
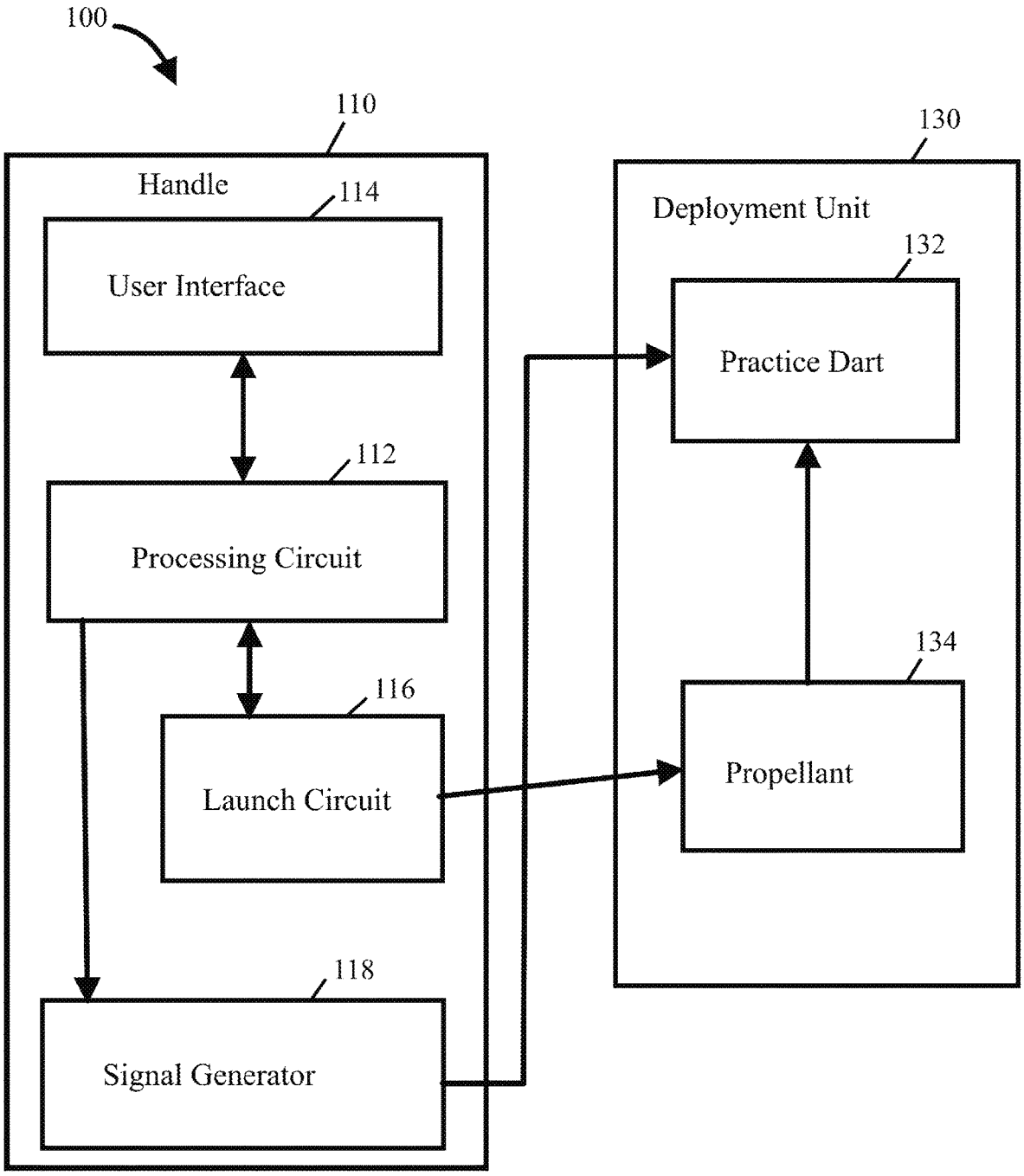
FIG. 1 is a block diagram of a conducted electrical weapon ("CEW") with a practice dart according to various aspects of the present disclosure.
Figure 2:
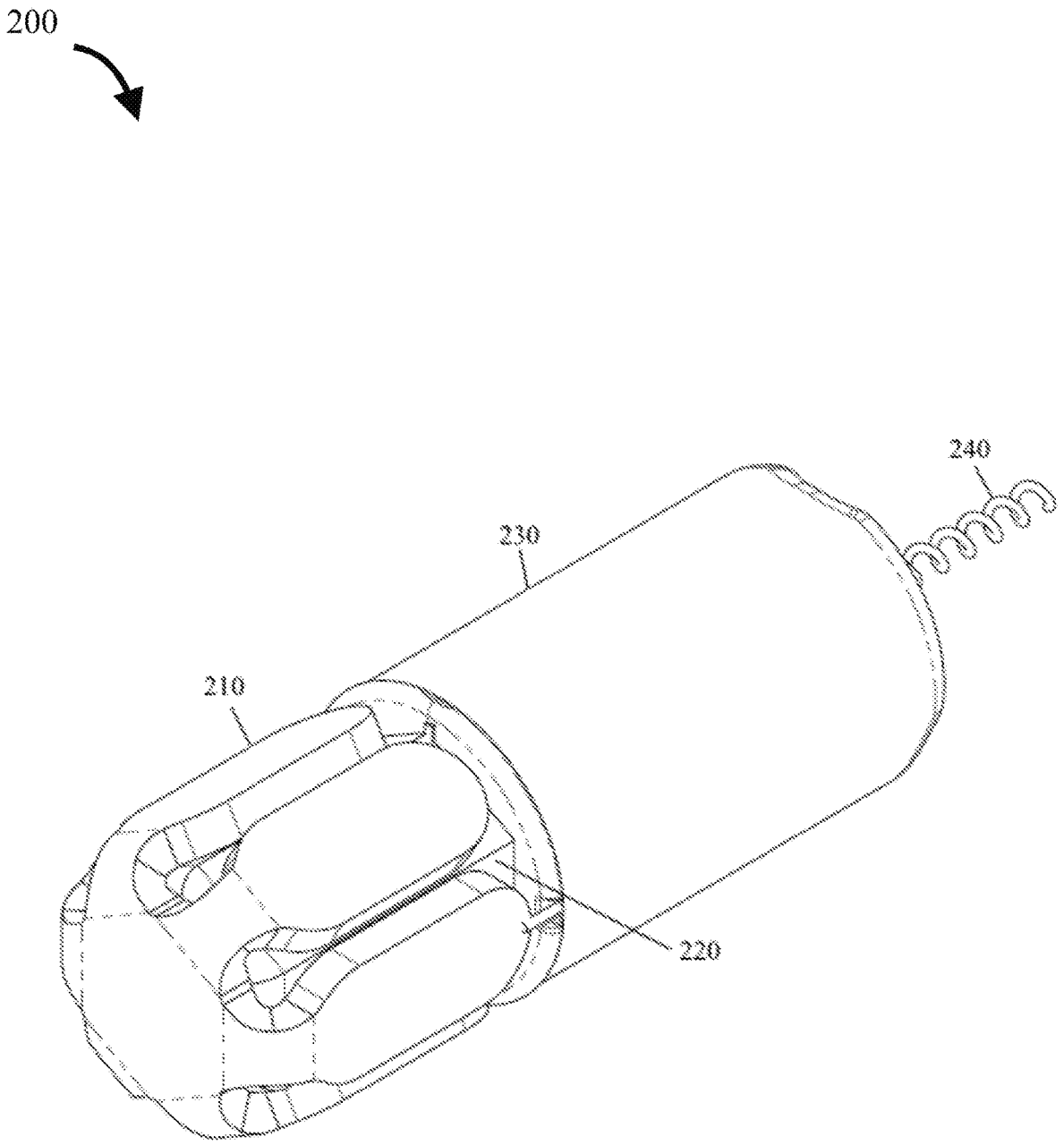
FIG. 2 is an implementation of a practice dart according to various aspects of the present disclosure.
Figure 3:
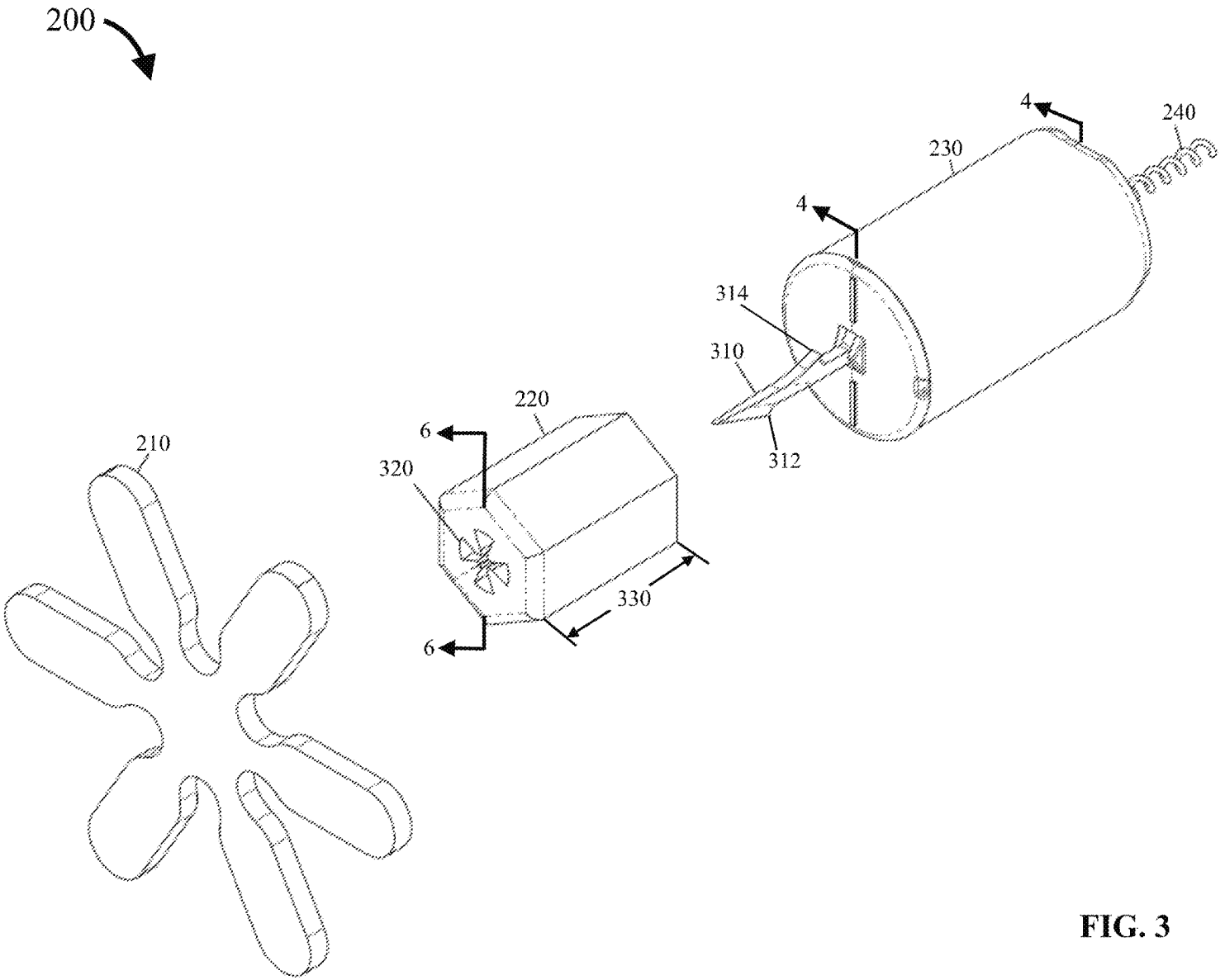
FIG. 3 is an expanded view of the dart of FIG. 2.
Figure 4:
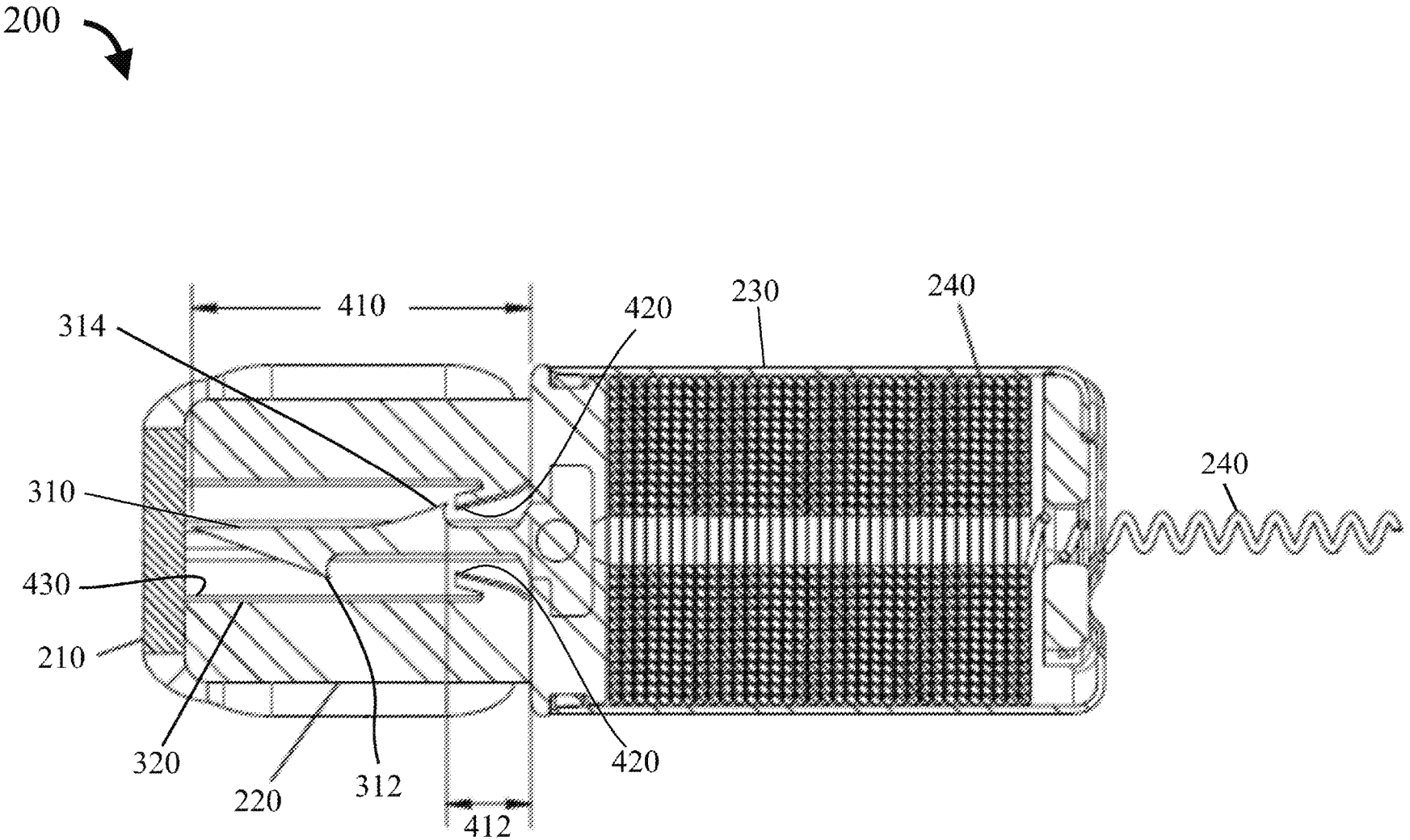
FIG. 4 is a cross-section of the practice dart of FIG. 3.
Figure 5:
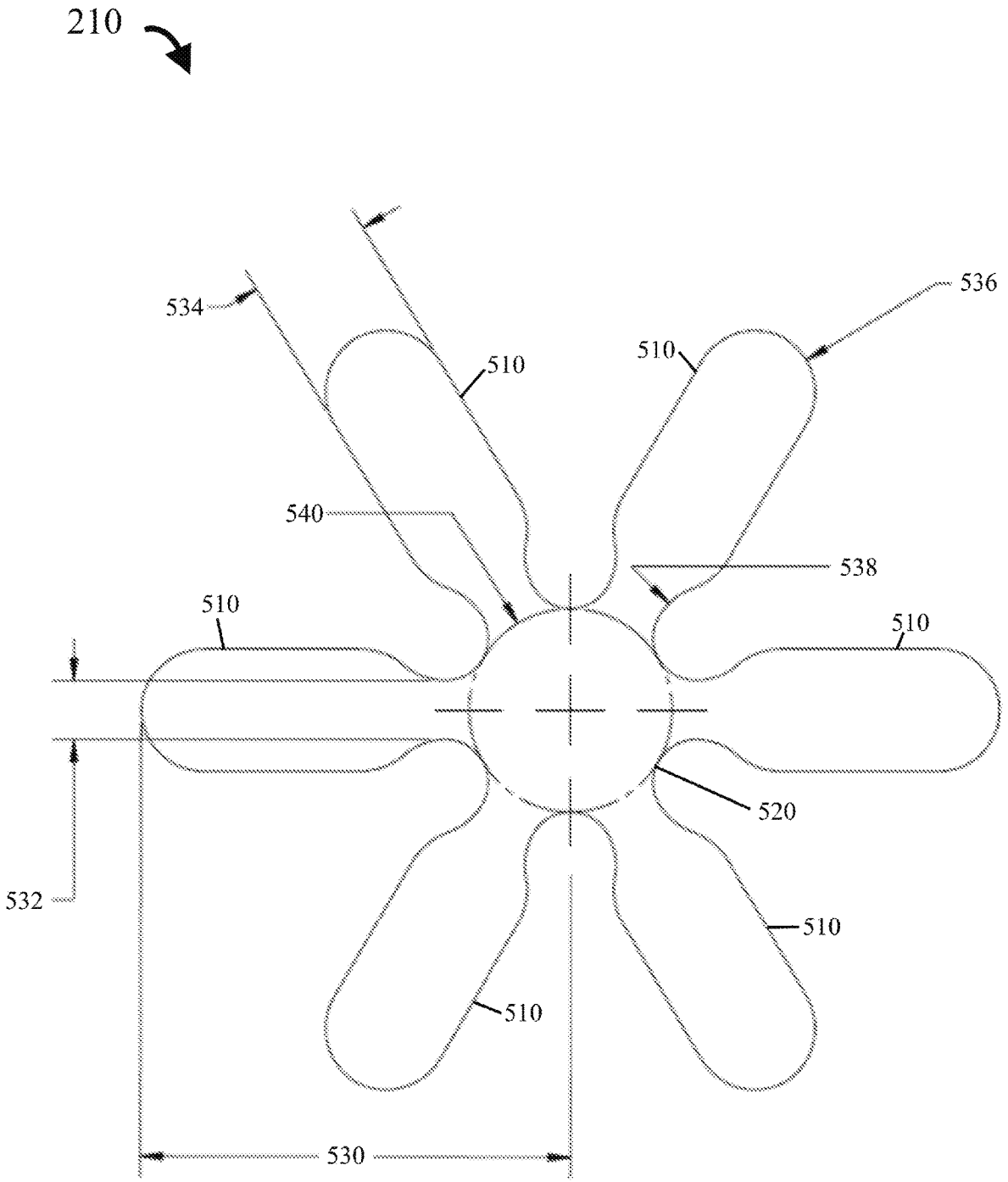
FIG. 5 is a front view of the overlay of FIGS. 2-4 and 8.
Figure 6:
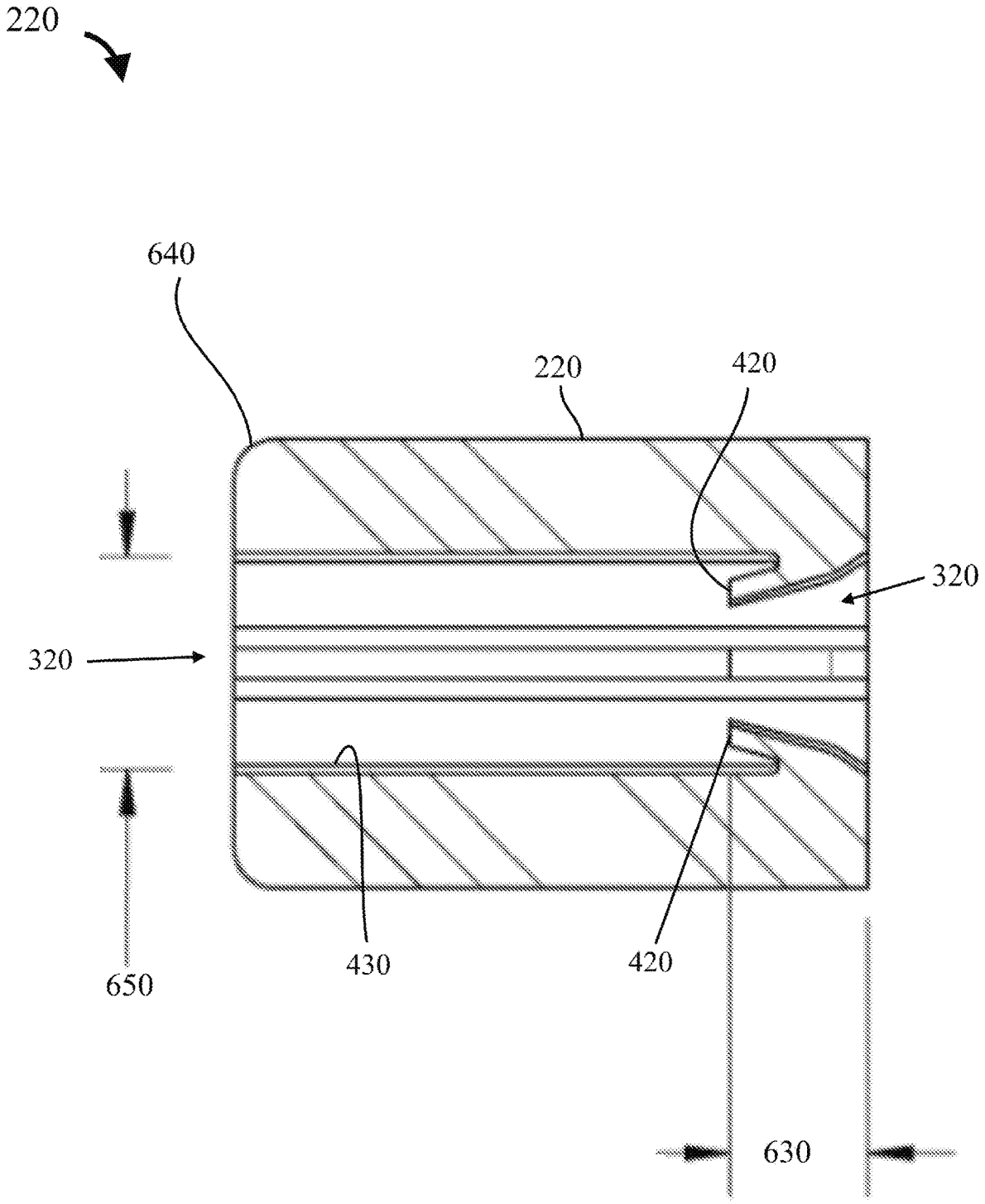
FIG. 6 is a cross-section of the cap of FIG. 3.
Figure 7:
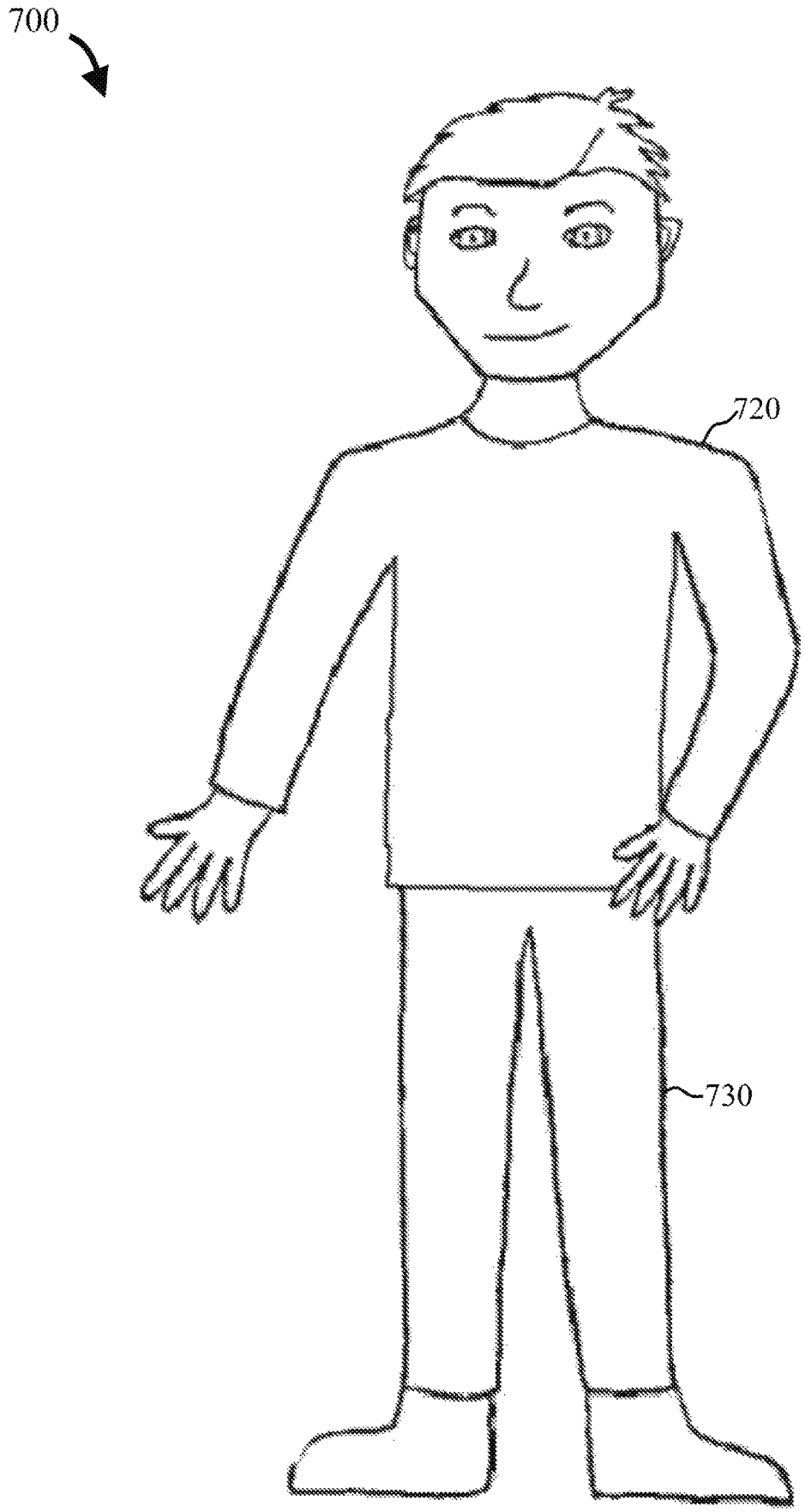
FIG. 7 is a diagram of an officer wearing a suit suitable for receiving and holding one or more practice darts.
Figure 8:
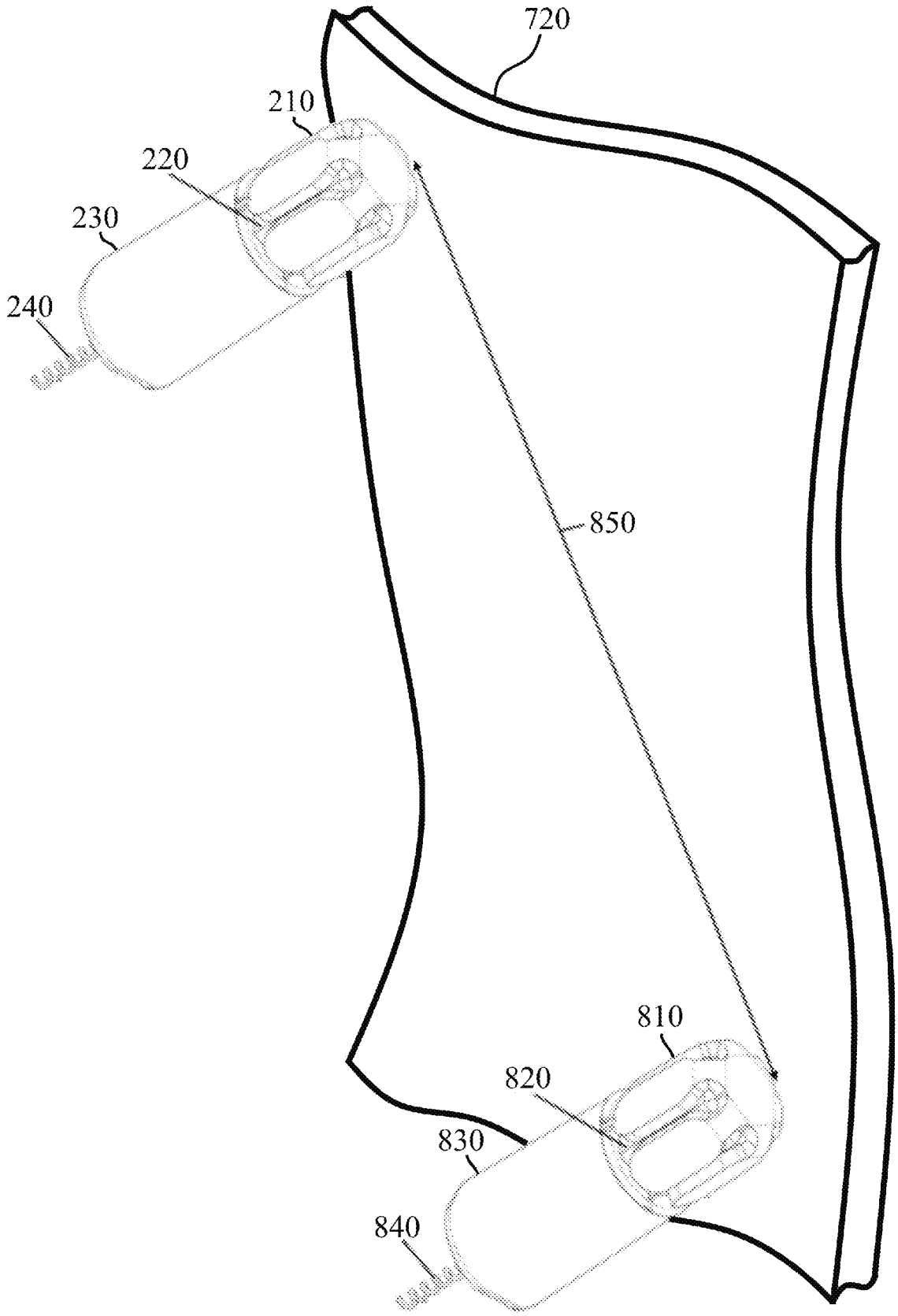
FIG. 8 is a diagram of two darts adhering to the suit of FIG. 7.

The numerical designators in the drawing indicate the following: 110: handle, 112: processing circuit, 114: user interface, 116: launch circuit, 118: signal generator, 130: deployment unit, 132: practice dart, 134: propellant, 200: practice dart, 210: overlay, 220: cap, 230: body, 240: filament, 310: spear, 312: barb, 314: barb, 320: passage, 330: length, 410: length, 412: barb position, 420: lip, 430: wall, 510: blade, 520: nose, 530: length, 532: width, 534: width, 536: end, 538: material, 540: edge, 630: height, 640: edge, 650: width, 700: officer, 720: shirt, 730: pants, 810: overlay, 820: cap, 830: body, 840: filament, and 850: distance.

DETAILED DESCRIPTION OF INVENTION

Police officers are issued equipment such as guns and conducted electrical weapons ("CEWs") in order to perform their duties. Police officers are required to practice with equipment in order to maximize its safe and effective use in a stressful situation. Preferably, training is performed on equipment as similar as possible to the equipment an officer uses in the field. Because a CEW is a less lethal weapon, training may include using a CEW to launch actual darts (e.g., electrodes) toward a human target.

A CEW may include a handle and a deployment unit (e.g., cartridge). A deployment unit may be removeably coupled to a handle. A deployment unit may include one or more darts (e.g., electrodes) and a propellant. Upon activation, the propellant propels the one or more darts toward a target. As the darts fly toward the target, a filament deploys between the one or more darts and the CEW so that the darts remain electrically coupled to the CEW. The filament may be stored in the body of a dart, so that movement of the dart toward the target deploys the filament to bridge (e.g., span) the distance between the target and the CEW.

The one or more darts impact the target. Upon impact, the one or more darts may mechanically couple to the target. Conventional electrodes (e.g., darts) use a spear for piercing target clothing and/or tissue. Spears typically include one or more barb. The one or more barbs mechanically couple to clothing or target tissue to retain the spear in target clothing and/or tissue.

While the darts are proximate to or embedded in target tissue, a signal generator of the CEW may provide a current (e.g., stimulus signal) through the target via the one or more electrodes. The current may impede locomotion of the target by causing pain and/or interfering with use of skeletal muscles of the target.

A typical CEW cartridge fires two darts. The spear of the darts may have barbs to retain the dart in target clothing and/or tissue. During training, a human target may wear protective clothing to reduce the effect of the current provided by the CEW and/or to reduce injury by the darts piercing and entering target tissue.

Training with a CEW against live targets may be improved, at least from the perspective of the target, by using a practice dart that is similar in weight and flight, but that does not pierce target clothing or tissue or deliver a high voltage current through the target.

In one implementation, a practice dart may modify the spear of the dart that pierces target tissue to include a structure for attaching a fired dart to the clothing of a user without piercing target tissue. Further, the conductive filament that stretches between a dart at the target and the signal generator of the handle may be replaced with a non-conductive filament to preclude delivery of a stimulus signal through the target.

A CEW suitable for practice on live targets includes handle 110 and deployment unit 130. Handle 110 includes user interface 114, processing circuit 112, launch circuit 116, and signal generator 118. Deployment unit 130 includes one or more practice darts 132 and propellant 134.

Handle 110 may include any conventional handle that performs the functions of a handle of a CEW and receives deployment units for launching darts. Practice dart 132 may operate in such a manner as to improve the live-target experience without requiring changes to handle 110. For example, a user could prepare for a practice session by replacing conventional deployment units that include darts with spears that have barbs with deployment unit 130 that is suitable for practice with no changes to handle 110.

A user interface may include one or more controls that permit a user to interact and/or communicate with a CEW. Via a user interface, a user may control (e.g., influence, select) the operation (e.g., function) of a CEW. A user interface may provide information to a user. A user may receive visual, haptic, and/or audible information via a user interface. A user may receive visual information via devices that visually display (e.g., present, show) information (e.g., LCDs, LEDs, light sources, graphical and/or textual display, display, monitor, touchscreen). A user interface may include a communication circuit for transmitting information to an electronic device (e.g., smart phone, tablet computer, laptop computer) for presentation to a user.

In an implementation, user interface 114 may include a trigger for initiating (e.g., starting) the launch of practice dart 132. Initiation of launch may be accomplished by activating propellant 134. Propellant 134 may provide a force to practice dart 132 to launch (e.g., move) practice dart 132 toward a target.

A processing circuit includes any circuitry and/or electronic subsystem for performing a function. A processing circuit may include circuitry that performs (e.g., executes) a stored program. A processing circuit may include a digital signal processor, a microcontroller, a microprocessor, an application specific integrated circuit, a programmable logic device, logic circuitry, state machines, MEMS devices, signal conditioning circuitry, communication circuitry, a radio, analog-to-digital converters, digital-to-analog converters, data busses, address busses, memory, and/or a combination thereof in any quantity suitable for performing a function and/or executing one or more stored programs.

A processing circuit may provide and/or receive electrical signals whether digital and/or analog in form using any conventional protocol. A processing circuit may receive information, manipulate the received information, and provide the manipulated information. A processing circuit may store information and retrieve stored information. A processing circuit may cooperate with a memory to store and/or retrieve information. Information received, stored, and/or manipulated by the processing circuit may be used to perform a function, control a function, and/or to execute a stored program.

A processing circuit may detect the operation of a control (e.g., button, switch, touch screen) of a user interface. A processing circuit may perform a function of the device responsive to operation of a control. A processor may perform a function, halt a function, resume a function, or suspend a function of the device of which the control and the processor are a part. A control may provide analog or binary information to a processor. Operation of a control includes operating an electromechanical device or selecting a portion of touch screen.

A processing circuit may control the operation and/or function of other circuits and/or components of a system. A processing circuit may receive status information regarding the operation of other components of a system, perform calculations with respect to status information, and provide commands (e.g., instructions) to one or more other components for the component to start operation, continue operation, alter operation, suspend operation, or cease operation. Commands and/or status may be communicated between a processing circuit and other circuits and/or components via any conventional protocol. A CEW handle may include a processing circuit. Each CEW deployment unit may include a processing circuit. A processing circuit of a handle may communicate with a processing circuit of a deployment unit when the deployment unit is in communication with the handle. Generally, a deployment unit may communicate with a handle when the deployment unit is physically coupled to the handle.

In an implementation, processing circuit 112 receives instructions from a user via user interface 114. Responsive to a user instruction (e.g., command), processing circuit 112 may perform one or more functions. Functions may include controlling (e.g., cooperate with) a power supply (not shown), signal generator 118, and/or launch circuit 116. Processing circuit 112 may control signal generator 118 in whole or part to provide a stimulus signal. Processing circuit 112 may control launch circuit 116 in whole or part to provide a launch signal to activate propellant 134 to provide a force to practice dart 132 to launch practice dart 132 from deployment unit 130.

A launch circuit provides a signal to a deployment unit to activate the launch of one or more darts (e.g. electrodes) from a deployment unit. The deployment unit contains a propellant (e.g., pyrotechnic, compressed gas). The launch signal produced by the launch circuit activates the propellant. As discussed above, upon activation of the propellant, one or more darts are launched from the deployment unit toward a target.

In an implementation, launch circuit 116 cooperates with processing circuit 112 to activate of propellant 134. Responsive to processing circuit 112, launch circuit provides an electrical signal to propellant 134. Responsive to the electrical signal, propellant 134 releases a force that propels practice dart 132. The force may include a rapidly expanding gas generated by combustion of a pyrotechnic and/or release of a compressed gas.

A signal generator provides a signal (e.g., stimulus signal) for interfering with locomotion (e.g., movement) of a human or animal target. A signal may include a current. A signal may include one or more pulses of current. A signal may include a series of (e.g., number, two or more) current pulses. A pulse of current may be provided at a voltage. Pulses may be delivered at a pulse rate (e.g., 22 pps) for a period of time (e.g., 5 seconds). Each pulse of a stimulus signal may have a pulse width.

A stimulus signal may be delivered to a target. A signal generator may provide a signal at a voltage of sufficient magnitude to ionize air in one or more gaps in series with the signal generator and the target to establish one or more ionization paths to sustain delivery of the signal through the target. The signal provided by a signal generator may provide a current through target tissue to interfere with (e.g., impede, disable) locomotion of the target. A signal generator may provide a signal at a voltage to impede locomotion of a target by inducing fear, pain, and/or an inability to voluntarily control skeletal muscles.

A signal generator may receive electrical energy from a power supply. A power supply may include a battery. A signal generator may convert the energy from one form of energy into a stimulus signal for ionizing gaps of air and/or interfering with locomotion of a target.

A CEW may utilize any conventional propellant to launch darts (e.g. electrodes) towards a target.

A practice deployment unit, such as deployment unit 130, performs many of the functions of a non-practice deployment unit before, during and after launch. A practice deployment unit performs many of the same functions of a non-practice deployment unit in the same manner as the non-practice deployment unit.

Before launch, a practice deployment unit stows one or more practice darts. The practice deployment unit has a form factor and control interface that is similar to a non-practice deployment unit, so that the practice deployment unit may be inserted into a conventional handle.

During launch, a practice deployment unit receives the same signals (e.g., launch signal, stimulus signal) provided to a non-practice deployment unit. The launch signal initiates propellant 134 to launch one or more practice darts, such as practice dart 132. A practice dart exits the practice deployment unit in the same manner as a non-practice dart.

In flight, a practice dart displays similar characteristics of motion to a non-practice dart. The movement of a practice dart toward a target deploys a filament behind the dart that mechanically, and possibly electrically, couples the practice dart to the deployment unit. A practice dart exits the deployment unit at about the same velocity as an electrode from a non-practice deployment unit. A practice dart strikes the target with about the same amount of force as the non-practice dart. However, a practice dart does not pierce the tissue of the target. A practice dart preferably does not deliver the current through the target even while the one or more practice darts are positioned proximate to target tissue.

Practice dart 132 performs the functions of a practice dart as discussed above. Dart 200 is an implementation of a practice dart. Dart 200 may include overlay 210, cap 220, dart 230, and filament 240. Dart 230 may include spear 310. Spear 310 may include one or more barbs, such as barb 312 and 314. Barbs 312 and 314 are positioned at various positions along a length of spear 310.

In an implementation, dart 230 may be a conventional electrode (e.g., dart, non-practice dart) that may be used in a conventional (e.g., non-practice) deployment unit. Even filament 240 may be a conventional filament that conducts the stimulus signal. Placing cap 220 over spear 310 reduces the likelihood that spear 310 will pierce the target and enter target tissue. Cap 220, if formed of a non-conductive material, will reduce the likelihood that the stimulus signal will be delivered to or through the target because cap 220 may interfere with formation of a circuit through the target.

In another implementation, dart 230 may be a conventional electrode in all aspects except for filament 240. A practice dart, as discussed above, may include a non-conductive filament. A non-conductive filament in all darts proximate to the target precludes delivery of the stimulus current to or through the target. Even if filament 240 is non-conductive, filament 240 may be wound and stowed in dart 230 just as a conventional, conductive filament would be wound and stowed in a conventional electrode so that the launch and flight characteristics of practice dart 132/200 are similar to the launch and flight characteristics of a conventional electrode.

A conventional CEW electrode may include a spear which lodges in target clothing or penetrates (e.g., pierces) target tissue to deliver a stimulus signal. A spear may include one or more barbs which prevents the easy removal of the spear from clothing or tissue. In an implementation of a practice dart, a cap may be placed over the spear and barbs to prevent puncturing target tissue and/or stop delivery of a stimulus signal.

To facilitate assembly of a practice dart, a cap may have one or more passages (e.g., tunnel, cavity) into which the spear of the dart may be positioned (e.g., penetrate, inserted into). A passage may have any shape such that the spear is covered when the cap is placed over the spear. Further, an interior surface of the cap may interfere with a portion of the spear (e.g., barb, base) to mechanically couple (e.g. fasten) the cap to the spear and/or the body of the dart.

A cap may couple to a dart by a mechanical interference between a barb of the spear and a portion of the cap. The interior of the cap may include one or more protruding lips (e.g., ridge, protrusion, projection, protuberance) positioned along wall 430 which interfere with one or more barbs of the spear to retain the cap around the spear. A lip may be positioned at any position along a circumference of the cavity. A lip may extend around the entire circumference of a cavity. For example, a round passage may have a lip which forms a circular ridge around an interior of the cap. A rectangular-shaped passage may have a lip on one or more sides of the passage. Passage width 650 may be of any width which allows the spear to be inserted into the passage to establish an interference between one or more of the barbs and the interior of the cap.

In an implementation, spear 310 has one or more barbs 312 and 314. Cap 220 has protruding lip 420 with height 630 and an overall cap length 330. Cap length 330 is sufficiently long such that spear 310 is fully covered (e.g., a tip of spear does not extend beyond cap 220) when spear 310 is positioned in passage 320. Barb 314 of spear 310 is positioned at distance 412 along length 410 of spear 310. Barb position 412 and lip height 630 are such that interferes with lip 420 interferes with barb 314 to mechanically retain cap 220 over spear 310. Lip 420 may flex (e.g., move) to permit barbs 312 and 314 to pass by lip 420 when spear 310 is inserted into passage 320.

Spear 310 may be further retained or solely retained (e.g., no lip) in passage 320 by an adhesive. An adhesive injected into (e.g., applied to) passage 320 before or after spear 310 is positioned in passage 320. An adhesive may mechanically couple spear 310 to an interior of cap 220. Applying an adhesive to the end portion of cap 220 that is positioned proximate to body 230 may mechanically couple cap 220 to body 230.

An overlay may be wrapped over and/or around a cap. An overlay enables a practice dart to attach (e.g., adhere) to a target without injury to the target. An overlay enables a practice dart to attach securely to a target. An overlay permits a dart to approach (e.g., fly toward) a target at a wide variety of angles and velocities and still securely attach. A target may wear (e.g., be covered with) a material (e.g., suit, particular clothing) that cooperates with the overlay to enable the overlay to securely attach to the target.

An overlay may be constructed of any material that couples to the material worn by the target. The material of an overlay may include a first structure and the material worn by the target may include a second structure so that when the overlay comes into contact with the material worn by the target, the first structure mechanically couples to the second structure to mechanically couple the overlay to the target suit.

For example, a hook-and-pile (e.g., hook-and-loop) material has two structures, hooks and loops. Hooks may be positioned on a piece of material that is separate from the material that includes the loops. A piece of material with hooks or loops may mechanically couple to a piece of material that has loops or hooks respectively when the materials come into contact. A hoop may mechanically couple to a hook and vice versa to mechanically couple to two previously separate materials together. A target suit may be formed, for example, of loop material and an overlay formed of hook material such that when the dart hits (e.g., impacts) the target suit, the dart adheres to the target suit.

An overlay may perform the additional function of reducing a force of impact transferred to a target. An overlay may be formed of a material that compresses on impact to reduce an amount of force transferred by the momentum of the practice dart to the target. An overlay may be formed of layers of different types of material to reduce a force of impact. Each layer may have different characteristics to reduce the transfer of force from a practice dart to a target. A thickness of one or more materials of an overlay may contribute to reducing a force of impact.

An exterior of a cap may have any shape. An overlay may cover all or part of the exterior of a cap. An overlay may cover only a portion of a cap that is most likely to strike a target (e.g., tip). An overlay may nearly completely cover a cap so that any portion of the cap that likely may strike a target is covered with the overlay to facilitate coupling the dart to the target. An overlay may further extend beyond a cap to cover all or part of a body of a dart.

An overlay may mechanically couple to a cap and/or a body of a dart using any conventional method.

Covering all sides of a cap with an overlay, as opposed to just the tip of the cap, facilitates coupling the practice dart to the target when the flight of the dart does not direct the tip of the dart directly toward the target. Generally, a bullet fired from a conventional firearm spins as it flies so that the tip of the bullet strikes the target as opposed to the side or back of the bullet. If the bullet does not spin at sufficiently high revolutions per minute, the bullet may tumble. If the bullet tumbles, at impact with the target, the bullet may be oriented such that the side of the bullet, as opposed to the tip, first strikes the target.

It is possible that a practice dart may not spin at a sufficiently high rate to maintain the tip of the practice dart directed toward the target. It is possible that the practice dart may be oriented at an angle, with respect to straight line flight from the CEW to the target, when the practice dart strikes the target. An overlay that covers at least a portion of the sides of a cap and/or body of the dart increases a likelihood that the material of the overlay will couple to the material of the suit worn by the target as discussed below.

It is also possible that the flight of a practice dart is oriented at an angle with respect to a target so that the practice dart would strike the target at an angle even if the flight of the practice dart oriented the tip toward the target. Further, due to the force exerted by the trailing filament of a practice dart and/or the relatively low velocity of flight, a practice dart may turn (e.g., change its orientation) on impact so that a side of the dart contacts the target. Regardless of the reason, a practice dart that includes an overlay on one or more of its sides increases the likelihood that the practice dart may couple to the target upon impact.

In an implementation, cap 220 has a hexagonal shape. An opening to passage 320 is positioned in a tip (e.g., top, end) of cap 220. The six sides of the hexagonal shape are positioned along length 330 of cap 220. Overlay 210 includes six blades 510. Each blade is suitable for covering one side of cap 220. Each blade has width 534. Width 534 roughly corresponds to the width of each side of cap 220. Each blade 510 flexibly couples to nose 520. The width of the material that couples each blade 510 to nose 520 is width 532. While overlay 210 is positioned to cover cap 220, nose 520 covers the tip of cap 220. Nose 520 may couple to tip of cap 220. Edge 540 of nose 520 may cover substantially all of the tip of cap 220.

Each blade 510 folds over cap 220 to be positioned on a respective side of cap 220. Each blade 510 may couple to a respective side of cap 220. The material 538 between each blade 510 and edge 540 of nose 520 may be reduced to width 532 to facilitate folding each blade 510 from nose 520 to the respective side of cap 220.

A length of each blade 510 may be length 530. In an implementation, length 530 may be approximately equal to length 330 of cap 220. In another implementation, length 530 may be greater than length 330 so that each blade 510 extends beyond cap 220 to body 230 of practice dart 200.

The shape and size of practice dart 200 with cap 220 and overlay 210 may be suitable to insert into the body of a non-practice deployment unit so that practice dart 200 may be launched from a conventional deployment unit having been launched using the conventional propellant as discussed above.

An overlay and a target suit may be formed using any conventional hook-and-loop material. A target suit may be formed entirely of the hook or loop portion of hook-and-loop material or hook or loop portion of hook-and-loop material may be positioned at particular locations on the target suit. An overlay, as discussed above, may include the loop or hook portion of hook-and-loop material and cover all or part of the cap and/or body.

In an implementation of a target suit, officer 700 wears shirt 720 and pants 730 made of a material suitable for coupling to overlay 210 of practice dart 200. In an implementation, shirt 720 and pants 730 are at least partially formed of hook-and-loop material that includes loops while overlay 210 of practice dart 200 is formed of hook-and-loop material that includes hooks. Officer 700 may further wear protective headgear also made of hook-and-loop material that includes loops.

Shirt 720 and pants 730 permit officer 700 to move (e.g., walk, run, jump, climb) so that during a practice session, officer 700 may play the part of a live target. During a practice session, CEW users may launch one or more darts toward officer 700. Officer 700 may be hit with one or more darts. One or more of the darts that strike officer may couple to shirt 720 and/or pants 730 worn by officer 700. Once a dart couples to shirt 720 or pants 730, the stimulus signal provided by the CEW may be blocked either by non-conductive cap 220 or by the fact that filaments 240 are non-conductive.

When one or more darts adhere to officer 700, the distance between darts is distance 850. The CEW user may detect distance 850 to determine whether distance 850 would be sufficient so that the stimulus signal would be likely to cause muscle lockup. If the distance is not suitable, the CEW user may launch additional darts to practice getting a suitable distance 850.

While the preferred embodiment of the invention has been illustrated and described, it will be appreciated that various changes can be made therein without departing from the spirit and scope of the invention. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. In the claims, the term "provided" is used to definitively identify an object that not a claimed element of the invention but an object that performs the function of a workpiece that cooperates with the claimed invention.

The location indicators "herein", "hereunder", "above", "below", or other words that refer to a location, whether specific or general, shall be construed to refer to any location in the specification.

What is claimed is:

1. An overlay for a dart of a conducted electrical weapon ("CEW") comprising:

a nose configured to couple to a tip of the dart; and a plurality of blades, each blade of the plurality of blades coupled to the nose and configured to fold over the dart; wherein responsive to the plurality of blades being folded over the dart, the overlay covers at least a portion of the dart and enables the dart to couple to a target upon impact of the dart with the target.

2. The overlay of claim 1, wherein the overlay is configured to mechanically couple to the target when deployed.

3. The overlay of claim 1, wherein the overlay includes one of a hook portion of a hook-and-loop fastener or a loop portion of the hook-and-loop fastener.

4. The overlay of claim 1, wherein the overlay is formed of a material that compresses upon the impact.

5. The overlay of claim 1, wherein the overlay is formed of a plurality of layers of different types of materials.

6. The overlay of claim 1, wherein plurality of blades comprises six blades.

7. The overlay of claim 1, wherein each blade of the plurality of blades covers a respective side of the dart responsive to being folded over the dart.

8. The overlay of claim 1, wherein the overlay is configured to cover all of a body of the dart.

9. A dart for a conducted electrical weapon ("CEW"), comprising a body; and an overlay coupled to the body of the dart to cover at least a part of the body, the overlay comprising:

a nose; and a plurality of blades, each blade of the plurality of blades flexibly coupled to the nose and mechanically coupled to the part of the body of the dart, wherein the overlay enables the dart to couple to a target upon impact of the dart with the target.

10. The dart of claim 9, wherein the overlay is configured to mechanically couple to the target.

11. The dart of claim 9, wherein the overlay includes one of a hook portion of a hook-and-loop fastener or a loop portion of the hook-and-loop fastener.

12. The dart of claim 9, wherein the overlay is formed of a material that compresses upon the impact.

13. The dart of claim 9, wherein the overlay is formed of a plurality of layers of different types of materials.

14. The dart of claim 9, further comprising a cap, wherein the cap comprises a passage configured to receive an inserted spear and the overlay is mechanically coupled to cap.

15. The dart of claim 14, wherein each blade of the plurality of blades covers a respective side of the cap.

16. The dart of claim 14, wherein the overlay is configured to extend beyond the cap to cover the part of the body.

17. A deployment unit comprising:

a propellant; and a dart comprising:

a body; and an overlay comprising:

a nose configured to couple to a tip of the dart; and blades coupled to the nose and at least a portion of the body of the dart, wherein:

activation of the propellant launches the dart from the deployment unit; and the overlay covers at least the portion of the body of the dart and enables the dart to couple to a target upon impact of the dart with the target.

18. The deployment unit of claim 17, further comprising a cap, the cap comprising a cavity configured to receive a spear, wherein the overlay is coupled to the cap and the portion of the body of the dart.

19. The deployment unit of claim 17, further comprising a filament mechanically coupling the body of the dart to the deployment unit.

20. The deployment unit of claim 19, wherein the filament comprises a non-conductive filament.

* * * * *